US008684259B2

(12) United States Patent
Makofsky et al.

(10) Patent No.: US 8,684,259 B2
(45) Date of Patent: Apr. 1, 2014

(54) POCKET FOLDER AND BLANK FOR MAKING SAME

(75) Inventors: Marvin A. Makofsky, Sands Point, NY (US); Robert Makofsky, New York, NY (US); Sari Makofsky McConnell, Burlingame, CA (US)

(73) Assignee: Conformer Products, Inc., Great Neck, NY (US)

( * ) Notice: Subject to any disclaimer, the term of this patent is extended or adjusted under 35 U.S.C. 154(b) by 71 days.

(21) Appl. No.: 13/535,989

(22) Filed: Jun. 28, 2012

(65) Prior Publication Data

US 2014/0001246 A1 Jan. 2, 2014

(51) Int. Cl.
*B65D 27/00* (2006.01)
*B65D 27/08* (2006.01)

(52) U.S. Cl.
USPC ..... 229/67.3; 229/72

(58) Field of Classification Search
USPC ..... 229/67.1–67.4, 72, 928
See application file for complete search history.

(56) References Cited

U.S. PATENT DOCUMENTS 2,353,669 A * 7/1944 James ..... 229/87.19
2,568,941 A * 9/1951 Benson ..... 229/72
3,073,508 A * 1/1963 Lee ..... 229/67.3
3,516,599 A * 6/1970 Buttery ..... 229/72
3,944,131 A * 3/1976 Weiss ..... 206/521
D295,536 S * 5/1988 Forbes, Jr. ..... D19/3
4,934,584 A * 6/1990 Wyant ..... 229/67.1
D313,040 S * 12/1990 Forbes ..... D19/3
D322,455 S * 12/1991 Forbes ..... D19/3
D322,456 S * 12/1991 Forbes, Jr. ..... D19/3
D322,457 S * 12/1991 Forbes, Jr. ..... D19/3
5,398,866 A * 3/1995 Bluemle ..... 229/68.1
6,193,147 B1 * 2/2001 Schluger ..... 229/67.3
6,227,444 B1 * 5/2001 Makoesky et al. ..... 229/313
6,564,994 B2 * 5/2003 Makofsky et al. ..... 229/313
6,666,610 B1 * 12/2003 Moor et al. ..... 402/79
8,162,204 B2 * 4/2012 Makofsky ..... 229/67.3
8,215,537 B2 * 7/2012 Makofsky ..... 229/67.3
2006/0060642 A1 * 3/2006 Rosier ..... 229/87.19
2007/0228118 A1 * 10/2007 Makofsky ..... 229/67.1

FOREIGN PATENT DOCUMENTS

JP 2006051968 A * 2/2006

* cited by examiner

*Primary Examiner* — Jes F Pascua

(74) *Attorney, Agent, or Firm* — Francis C. Hand; Carella, Byrne, et al

(57) ABSTRACT

The pocket folder is made from a single sheet blank and has a pair of pockets and reinforced side edges. The pockets may be open pockets or one of the pockets may be closed while the other is open.

7 Claims, 3 Drawing Sheets

POCKET FOLDER AND BLANK FOR MAKING SAME

This invention relates to an improved pocket folder and to a blank for making the pocket folder.

As is known, various types of pocket folders have been constructed for the holding of sheets of paper and the like. One conventional folder is constructed with a pair of sections that are foldable along a vertical fold line to lay over each other. In addition, one or both sections is constructed with a pocket for receiving sheets of paper and the like. However, because of the nature of the construction of the folder sections, the pocket in each section has a rather limited capacity.

In order to increase the capacity of a pocket of a pocket folder, it has been known to construct the pocket folder as described in U.S. Pat. No. 6,116,651. As described therein, each section of the folder is provided with score lines in order to permit the sections to expand away from each other in order to enlarge the thickness of the pockets and thus the capacity of the pockets upon the insertion of materials while encouraging a flat appearance when the folder is closed. Each pocket is also provided with score lines to allow the front of the pocket to also expand upon the insertion of sheets of paper into the pocket.

It has also been known from Published US Patent Application 2007/022811 to provide an expandable pocket folder with a closed pocket that is able to retain sheets of paper in a secure manner.

Prior art pocket folders have been known to be formed with reinforced edges. However, the construction of these reinforced edges limits capacity in the pockets and/or makes the edges or the pockets themselves tear easily when the pockets are filled with content.

Accordingly, it is an object of the invention to reinforce the side edges of an expandable pocket folder in a relatively simple effective manner.

It is another object of the invention to reduce the risk of tearing of a pocket folder with reinforced edges.

It is another object of the invention to provide reinforcement to a pocket folder without limiting the capacity of the pocket folder.

It is another object of the invention to provide a simple blank for making an expandable pocket folder using a limited size of paper.

Briefly, the invention provides a one-piece blank for making a pocket folder that is provided with a closed or open pocket and reinforced side edges as well as an expandable pocket folder made from the blank.

The blank is made of conventional card stock or other paperboard or plastic product with at least a pair of contiguous rectangular sections for folding over on each other. In addition, an extension extends from a bottom edge of each section for folding over the section to form a pocket. Flaps are also provided to cooperate with the extensions to close in one or both sides of a pocket.

In accordance with the invention, an additional flap extends from a side edge of each section of the blank for folding over the section to reinforce the edge. When folded over in creating a folder, each additional flap creates a reinforced edge that is double the thickness of the blank in an area of the folder that is frequently grasped by the user when the folder is held open. This double thickness contributes to the perception of the folder's quality and strength. In addition, the reinforced edge creates a closed folder that is uniform in thickness allowing for uniform stacking and cartoning for shipment and storage.

These and other objects and advantages of the invention will become more apparent from the following detailed description taken in conjunction with the accompanying drawings wherein.

Figure 1:
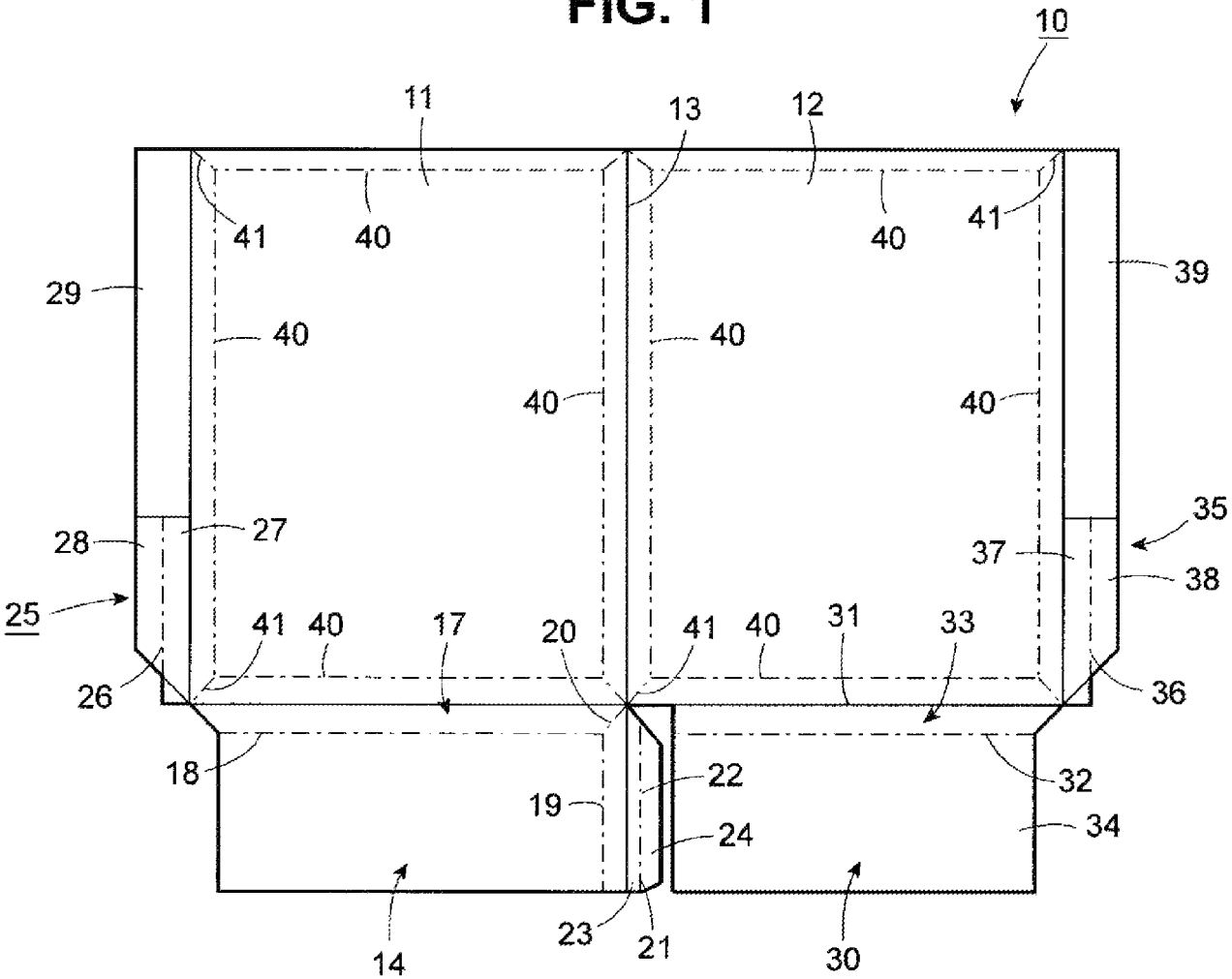
FIG. 1 illustrates a view of the backside of a blank used to make a pocket folder in accordance with the invention.

Referring to FIG. 1, the blank 10 is a flat sheet of conventional paper or other suitable material, such as described in published US Patent Application 2007/022811, divided into a pair of contiguous rectangular sections 11, 12 that are separated by a vertical fold line 13.

Figure 2:
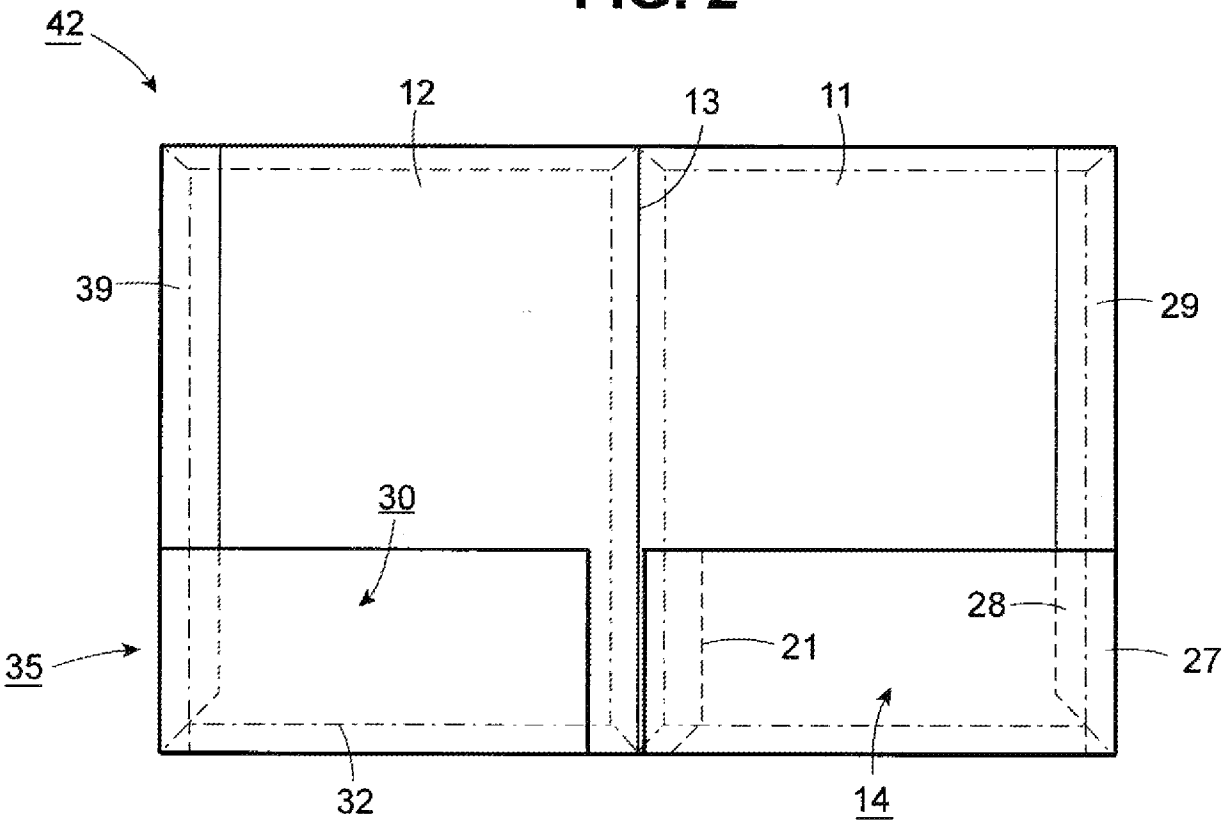
FIG. 2 illustrates a perspective front side view of a pocket folder made from the blank of FIG. 1 in a partially opened condition in accordance with the invention.

One section 11 has an extension 14 extending from a bottom edge 17 for folding over the section 11 to define a pocket, shown in FIG. 2. This extension 14 has a horizontally disposed score line 18 spaced from the bottom edge 17 of the section 11, a vertically disposed score line 19 spaced from a side edge thereof and an angularly disposed score line 20 extending from an intersection of the horizontally disposed score line 18 and the vertically disposed score line 19 to a respective corner of the extension 14.

The extension 14 also has a flap 21 extending from one side for folding under the extension 14 with the extension 14 folded over the section 11. This flap 21 has a vertically disposed score line 22 intermediately thereof to separate the flap 21 into a first part 23 contiguous to the extension 14 and a second part 24 folded flat against and secured to the section 11. The second part 24 of the flap 21 is secured by a suitable adhesive or glue to the back section 11 while the first part 23 is free to move relative to the back section 11.

In this case, the first part 23 of the flap 21 and the part of the extension between the score line 19 and the flap 21 may each be provided with a plurality of vertical score lines, e.g. three score lines, to assist in folder pocket expansion. These score lines serve to relax the tension in the pocket at a critical point and prevent a section 11, 12, 14 from tearing when inserting a large volume of material into the pocket.

The section 11 also has a flap 25 extending from one side edge of the section 11 for folding over or under the extension 14 with the extension 14 folded over the section 11. This flap 25 has a vertically disposed score line 26 intermediately thereof to separate the flap 25 into a first part 27 contiguous to the section 11 and a second part 28 folded flat against and secured to the extension 14. The second part 28 of the flap 25 is secured by a suitable adhesive or glue to the extension 14 while the first part 27 is free to move relative to the back section 11.

The flap 25 may be provided with additional score lines, e.g. two additional score lines, to assist in folder pocket expansion. In addition, this first part 27 of the flap 25 has an area at the bottom which meets up with the extension 14 and serves to reinforce the corner of the expandable pocket when in use while remaining open so that the capacity of the corner is maximized.

The section 11 also has a second flap 29 extending from the side edge of the section 11 for folding over the edge of the section 11 to reinforce the edge of the section 11. This flap 29 is of the same width as the flap 25 and extends from the flap 25 over the remaining height of the section 11. The flap 29 is secured by a suitable adhesive or glue to the back section 11.

Alternatively, the second flap 29 may have a vertical score line (not shown) colinear with the score line 26 in the flap 25 for aesthetic purposes.

The second section 12 of the blank 10 has an extension 30 that is contiguous to and that extends from the bottom edge 31 via a fold line. This extension 30 includes a horizontal score line 32 that divides the extension 30 into an inner part 33 contiguous to the back section 12 and a rectangular part 34 that is to form the front face of a pocket on the back section 12.

The section 12 also has a flap 35 that extends from the back section 12 to be folded over or under the extension 30. This flap 35 has a vertically disposed score line 36 at an intermediate point to separate the flap 35 into a first part 37 contiguous to the back section 12 and a second part 38 to be folded flat over or against the underside of the extension 30.

The section 12 also has a second flap 39 extending from the side edge of the section 12 for folding over the edge of the section 12 to reinforce the edge of the section 12. This flap 39 is of the same width as the flap 35 and extends from the flap 35 over the remaining height of the section 12. The flap 39 is secured by a suitable adhesive or glue to the back section 12.

Referring to FIG. 1, each section 11, 12 may be provided with horizontal and vertical score lines 40 to define a rectangular frame as well as angularly disposed score lines 41, each of which extends from an intersection of a respective horizontally disposed score line 40 and a vertically disposed score line 40 to a respective corner of the section 11, 12. Alternatively, only the section 11 with the closed pocket need be provided with these score lines 40, 41.

Of note, the score lines 40 on the sections 11, 12 are optional. When present, the score lines 40 contribute to aesthetics and flatness of folder when closed but do not impact pocket capacity in a meaningful way.

In order to form a pocket folder from the blank 10, a suitable adhesive or glue is applied to the flaps 21, 25, 35, 29, and 39 and folding is performed on the extensions 14, 30 and the flaps 21, 25, 35, 29, and 39 as described above. This sequence of steps, as shown in FIG. 2, forms a folder 42 wherein the section 11 forms the back of the folder and the other section 12 forms the front of the folder 42. In addition, there is a closed pocket on the section 11, an open-sided pocket on the other section 12 and reinforced side edges on both sections 11, 12.

Referring to FIG. 1, the width of the extension 14 exclusive of the flap 21 is such that the free vertical edge of the extension 14 coincides with the vertical score line 40 in the section 11 while the vertical score line 19 in the extension 14 coincides with the other vertical score line 40 in the section 11. Likewise, the score line 26 in the flap 25 is positioned to coincide with the same score line 40 when the flap 25 is folded over the section 11.

Also referring to FIG. 1, the extension 30 on the second section 12 is of a width such that the right-hand edge as shown in FIG. 1 is colinear with the vertical score line 40 in the section 12 while the left-hand edge as shown is spaced laterally from the other vertical score line 40 in the section 12 to provide for an open pocket in the finished folder as shown in FIG. 2.

Each of the flaps 29, 39 for reinforcing the edge of the folder may be spaced a small vertical distance from the respective flaps 25, 35 to facilitate folding. Also, the outer parts 28, 38 of the respective flaps 25, 35 may be tapered away from the reinforcing flaps 29, 39.

Figure 3:
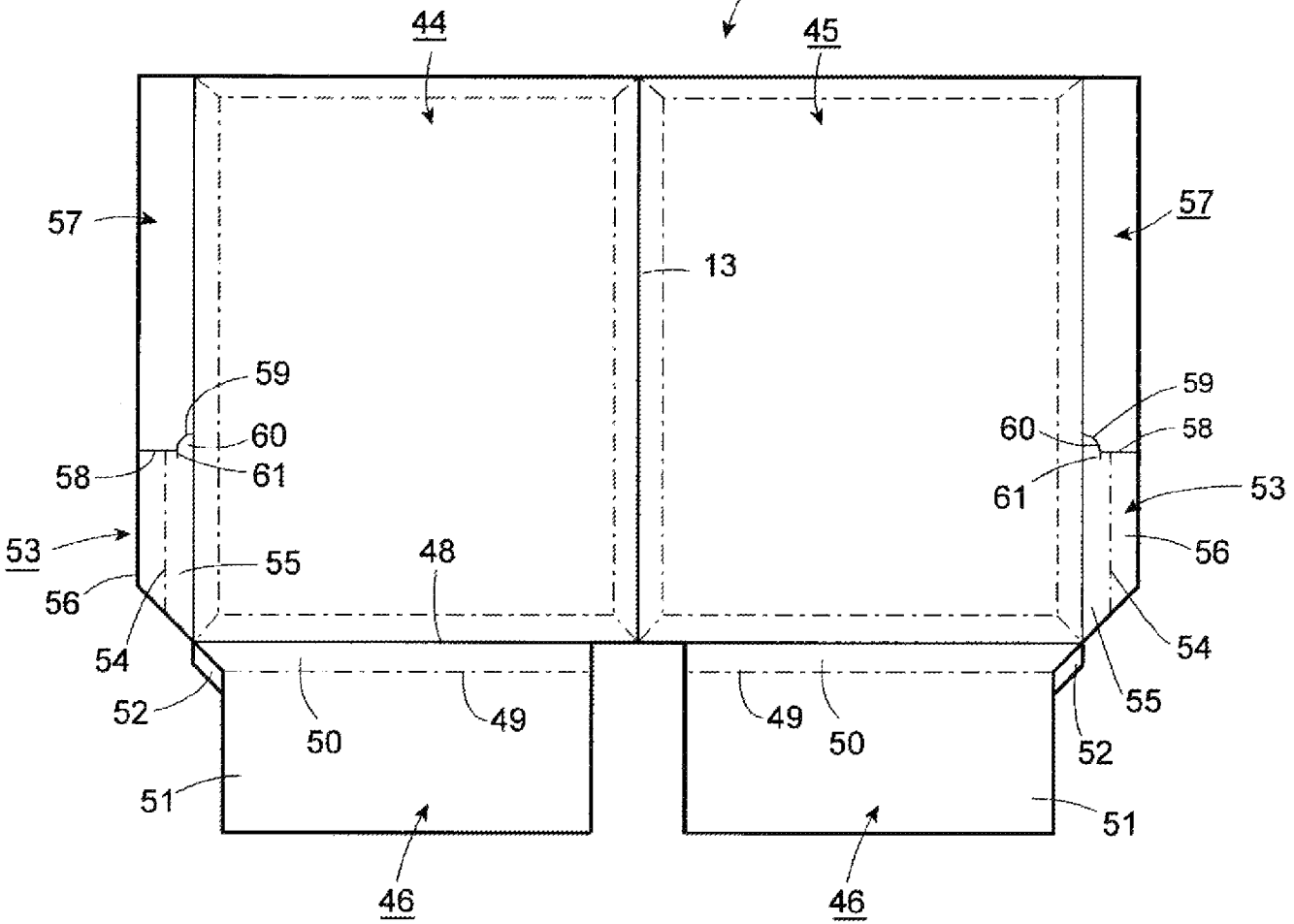
FIG. 3 illustrates a modified pocket folder made in accordance with the invention.

Referring to FIG. 3, in another embodiment, the blank 43 is divided into a pair of contiguous rectangular sections 44, 45 that are separated by a vertical fold line 13. Each of the sections 44, 45 is a mirror image of the other; hence only one section 44 will be described herein.

The left-hand section 44, as viewed, has an extension 46 extending from a bottom edge 48 defined by a fold line for folding the section 44 to define an open pocket. This extension 46 has a horizontally disposed score line 49 spaced from the bottom edge of the section 44 that divides the extension 46 into a trapezoidal section 50 adjacent the section 44 and a rectangular section 51. In addition, the extension has a small rhombic-shaped tab 52 extending outwardly of the trapezoidal section 50 and rectangular section 51. This tab 52 serves to reinforce the corner of the expandable pocket when in use.

The section 44 also has a flap 53, extending from one side edge of the section 44 for folding over or under the extension 46 with the extension 46 folded over the section 44. This flap 53 has a vertically disposed score line 54 intermediately thereof to separate the flap 53 into a first part 55 contiguous to the section 44 and a second part 56 folded flat against and secured to the extension 46. The second part 56 of the flap 53 is secured by a suitable adhesive or glue to the back section 44 while the first part 55 is free to move relative to the back section 44.

The section 44 also has a second flap 57 extending from the side edge of the section 44 for folding over the edge of the section 44 to reinforce the edge of the section 44. This flap 57 is of the same width as the flap 53 and extends from the flap 53 over the remaining height of the section 44. The flap 57 is secured by a suitable adhesive or glue to the back section 44.

In this embodiment, the two flaps 53, 57 are initially integral with each other. During manufacture, the two flaps 53. 57 are separated by a rectilinear cut 58 and a curvilinear cut 59. As illustrated, the cuts 58, 59 overlap so that a tab 60 is formed as an extension of the first part 55 of the flap 53 with a relief cut 61 between the tab 60 and the remainder of the first part 55. The reinforcing flap 57 is shaped in a mating manner to receive the tab 60 in a recess.

When in use in the finished pocket folder, the tab 60 prevents the folder from tearing when the pocket formed by the extension 44 is filled.

In another embodiment, the first part 55 of each flap 53 may be provided with a plurality of vertical score lines, e.g. three score lines, to assist in folder pocket expansion.

In still another embodiment, the blank 43 of FIG. 3 may be formed with an extension 14 as in FIG. 1 in order to provide a closed pocket on one side of a finished folder.

The invention thus provides a blank that can be made with a minimum of material in order to form an expandable pocket folder with pockets and reinforced side edges.

What is claimed is:

1. A one piece blank for making a folder comprising at least a pair of rectangular sections;

a first extension extending from a bottom edge of one of said sections for folding over said one section to define an open pocket, said extension having a horizontally disposed score line spaced from a bottom edge of said one section dividing said extension into a trapezoidal section adjacent said one section and a rectangular section and having a rhombic-shaped tab extending outwardly of said trapezoidal section and said rectangular section;

a first flap extending from a side edge of said one section and having a vertically disposed score line intermediately thereof to separate said first flap into a first part contiguous to said one section and a second part for folding flat against said extension;

a second flap extending from said side edge of said one section for folding over said one section to reinforce an edge of said one section; and a third flap extending from a side edge of the other of said sections for folding over said other section to reinforce said side edge of said other section.

2. A one piece blank as set forth in claim 1 wherein said first flap has a tab extending therefrom and said second flap has a recess receiving said tab in mating relation.

3. A one piece blank as set forth in claim 1 wherein a second extension extends from a bottom edge of the other of said sections for folding over said other section to define an open pocket, said second extension having a horizontally disposed score line dividing said second extension into a trapezoidal section adjacent said other section and a rectangular section and having a rhombic-shaped tab extending outwardly of said trapezoidal section and said rectangular section; and a fourth flap extends from a side edge of said other section and has a vertically disposed score line intermediately thereof to separate said fourth flap into a first part contiguous to said other section and a second part for folding flat against said second extension.

4. A one piece blank as set forth in claim 3 wherein said fourth flap has a tab extending therefrom and said third flap has a recess receiving said tab in mating relation.

5. A one piece blank as set forth in claim 1 wherein a second extension extends from a bottom edge of the other of said sections for folding over said other section to define a closed pocket, said second extension having a horizontally disposed score line dividing said second extension into a trapezoidal section adjacent said other section and a rectangular section and having a rhombic-shaped tab extending outwardly of said trapezoidal section and said rectangular section; and a fourth flap extends from said extension for folding relative to said second extension with said second extension folded over said other section, said fourth flap having a vertically disposed score line intermediately thereof to separate said fourth flap into a first part contiguous to said second extension and a second part folded flat against and secured to said other section.

6. A folder comprising at least a pair of rectangular sections;

a first extension extending from a bottom edge of one of said sections and folded over said one section to define an open pocket, said extension having a horizontally disposed score line spaced from a bottom edge of one section dividing said extension into a trapezoidal section adjacent said one section and a rectangular section and having a rhombic-shaped tab extending outwardly of said trapezoidal section and said rectangular section;

a first flap extending from a side edge of said one section and secured to said extension, said first flap having a vertically disposed score line intermediately thereof to separate said first flap into a first part contiguous to said one section and a second part folded flat against and secured to said first extension;

a second flap extending from said side edge of said one section and folded over said one section to reinforce an edge of said one section; and a second extension extends from a bottom edge of the other of said sections and folded over said other section to define an open pocket, said second extension having a horizontally disposed score line dividing said second extension into a trapezoidal section adjacent said other section and a rectangular section and having a rhombic-shaped tab extending outwardly of said trapezoidal section and said rectangular section;

a third flap extending from a side edge of said other section and having a vertically disposed score line intermediately thereof to separate said third flap into a first part contiguous to said other section and a second part for folding flat against said second extension; and a fourth flap extending from a side edge of the other of said sections for folding over said other section to reinforce said side edge of said other section.

7. An open pocket construction comprising a rectangular section;

a first extension extending from a bottom edge of said section and folded over said section to define an open pocket, said extension having a horizontally disposed score line spaced from said bottom edge of said section and dividing said extension into a trapezoidal section adjacent said rectangular section and a rectangular section to form a front face of the open pocket;

a first flap extending from one side of said section and secured to said extension, said first flap having a vertically disposed score line intermediately thereof to separate said first flap into a first part contiguous to said section and a second part folded flat against and secured to said extension;

a tab extending from one of said trapezoidal section of said first extension and said first part of said first flap to reinforce a corner of said open pocket;

a second flap extending from said one side of said section and folded over said section to reinforce an edge of said section.

* * * * *